US005230463A

United States Patent [19]

Brauner

[11] Patent Number: 5,230,463

[45] Date of Patent: Jul. 27, 1993

[54] PACKAGE INCLUDING A GABLE-SHAPED TOP

[75] Inventor: Arne H. Brauner, Minnetonka, Minn.

[73] Assignee: General Mills, Inc., Minneapolis, Minn.

[21] Appl. No.: 908,101

[22] Filed: Jul. 2, 1992

[51] Int. Cl.[5] ..... B65D 5/08

[52] U.S. Cl. ..... 229/138; 229/149; 229/208

[58] Field of Search ..... 229/138, 140, 149, 208, 229/213, 223, 117.12, 40; 220/462; 206/45.31

[56] References Cited

U.S. PATENT DOCUMENTS

| | | | |
|---|---|---|---|
| 265,589 | 10/1882 | Fiske . | |
| 1,725,211 | 8/1929 | Roser . | |
| 1,953,885 | 4/1934 | McAleer . | |
| 1,963,378 | 6/1934 | Petter . | |
| 1,983,010 | 12/1934 | Spees | 229/149 |
| 2,345,486 | 3/1944 | Leebov | 229/149 |
| 3,022,930 | 2/1962 | Kuchenbecker | 229/117.12 |
| 3,228,573 | 1/1966 | Nerenberg et al. . | |
| 3,403,839 | 10/1968 | Farquhar | 229/40 |
| 3,688,972 | 9/1972 | Mahon | 229/40 |
| 3,827,624 | 8/1974 | Dogliotti | 229/149 |
| 3,899,124 | 8/1975 | Desmond et al. | 229/149 |
| 3,924,800 | 12/1975 | Desmond et al. . | |
| 4,042,110 | 8/1977 | Guernsey | 229/149 |
| 4,099,665 | 7/1978 | Bergstein | 229/149 |
| 4,106,615 | 8/1978 | Hiroshi | 206/45.31 |
| 4,243,171 | 1/1981 | Prin | 229/149 |

FOREIGN PATENT DOCUMENTS

| | | | |
|---|---|---|---|
| 3929887 | 3/1991 | Fed. Rep. of Germany . | |
| 779848 | 4/1935 | France | 229/149 |
| 1514373 | 2/1968 | France | 229/149 |
| 555422 | 5/1958 | Italy | 229/117.12 |
| 823278 | 11/1959 | United Kingdom | 229/138 |

*Primary Examiner*—Gary E. Elkins

*Attorney, Agent, or Firm*—L. MeRoy Lillehaugen; John A. O'Toole; Alan D. Kamrath

[57] ABSTRACT

A package (10) including a gable-shaped top is disclosed including an outer carton (12) and an inner liner (14). The carton (12) is formed from a single layer blank (16) which is printed only on the outer surface (17). The gable-shaped top includes first and second side panels (54, 66) which are divided into first and second right triangles (84, 86) and an isosceles trapezoid (88) by fold lines (74, 76) including perforations (82). End flaps (90, 92) are further provided having lengths equal to the lengths of the legs of the right triangles (84, 86) and having widths equal to the lengths of the minor bases of the isosceles trapezoids (88). The top panel (94) of the gable-shaped top is held with the inside surfaces (19) of the right triangles (84, 86) abutting with the inside surfaces (19) of the front and back panels (46, 60), with the end flaps (90, 92) extending perpendicularly between the legs of the right triangles (84, 86), and with the inside surface (19) of the top panel (94) abutting with the inside surfaces (19) of the end flaps (90, 92), the legs of the right triangles (84, 86) and the top edge of the front panel (46) giving the package (10) a totally finished appearance.

14 Claims, 2 Drawing Sheets

PACKAGE INCLUDING A GABLE-SHAPED TOP

BACKGROUND

The present invention generally relates to packages, particularly to packages formed from a blank of a single layer of material, and specifically to packages including a gable-shaped top.

In the marketing of many types of products such as breakfast cereals, the packaging itself plays an important part in the product merchandising. In addition to the printed material appearing thereon, the shape of the package can play a major role in attracting the attention of the consumer towards the product and hopefully resulting in the purchase thereof. Specifically, most products are marketed in packages of rectangular parallelepiped shapes. Thus, packages having shapes different from rectangular parallelepiped shapes will have a tendency to attract the consumer's attention. However, it is desired to have the non-standard shaped packages be able to be displayed in the same areas as packages of standard shapes would be displayed in both their ability to be stacked in columns and rows in the display area as well as their ability to be stacked vertically in the display area. One such type of package of non-standard shape that has gained some market acceptance are those including a gable-shaped top.

However, the production of packages including gable-shaped tops has resulted in other problems which has reduced its market acceptance. Specifically, the inside surface of at least certain portions of the package were visible to the consumer. Thus, the merchandiser was faced with the problem of the costly procedure of obtaining double-sided printable blanks and printing both the inside and outside surfaces of the carton to arrive at a total "finished" package or settle with the unprinted inside surface being exposed to the consumer which detracted from the total appearance of the package. Thus, a need exists for a package including a gable-shaped top formed from a blank of a single layer of material which is only printed on the outside surface and having a totally "finished" appearance.

SUMMARY

Surprisingly, the above need and other problems in the field of packages including gable-shaped tops have been solved by providing, in the preferred form, first and second top end flaps having lengths equal to the lengths of the legs of first and second right triangles formed in the side panels by fold lines and having widths equal to the length of the minor bases of generally isosceles trapezoids also formed by the fold lines in the side panels. The top panel is held with the inside surfaces of the first and second right triangles of the first and second side panels abutting with the inside surfaces of the front and back panels, with the end flaps extending perpendicularly between the second legs of the first and second right triangles of the first and second side panels, and with the inside surface of the top panel abutting with the inside surfaces of the end flaps, the first legs of the first and second right triangles, and the top edge of the front panel.

DESCRIPTION OF THE DRAWINGS

The illustrative embodiment may best be described by reference to the accompanying drawings where.

Figure 1:
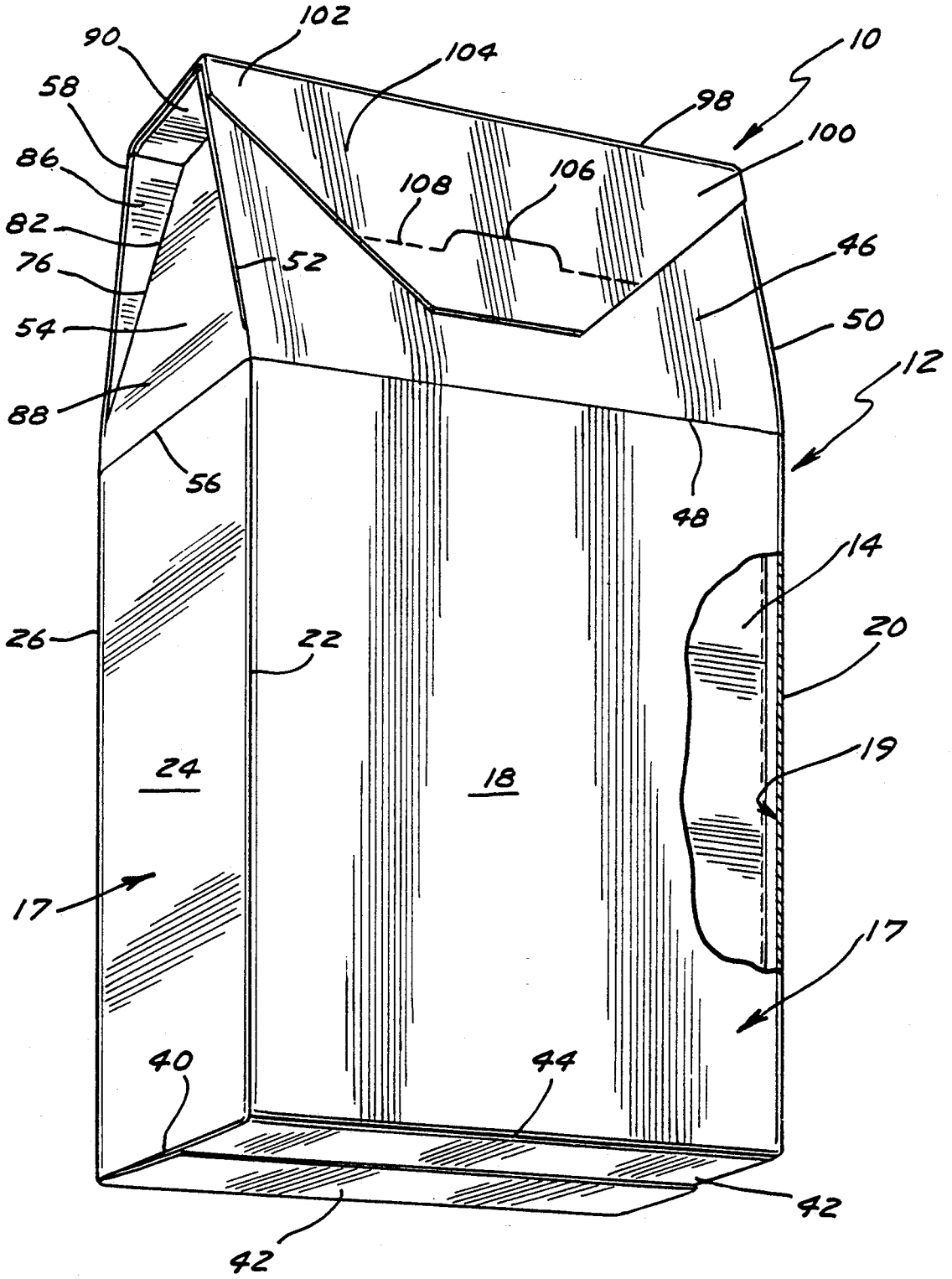
FIG. 1 shows a perspective view of a package including a gable-shaped top according to the preferred teachings of the present invention.
Figure 2:
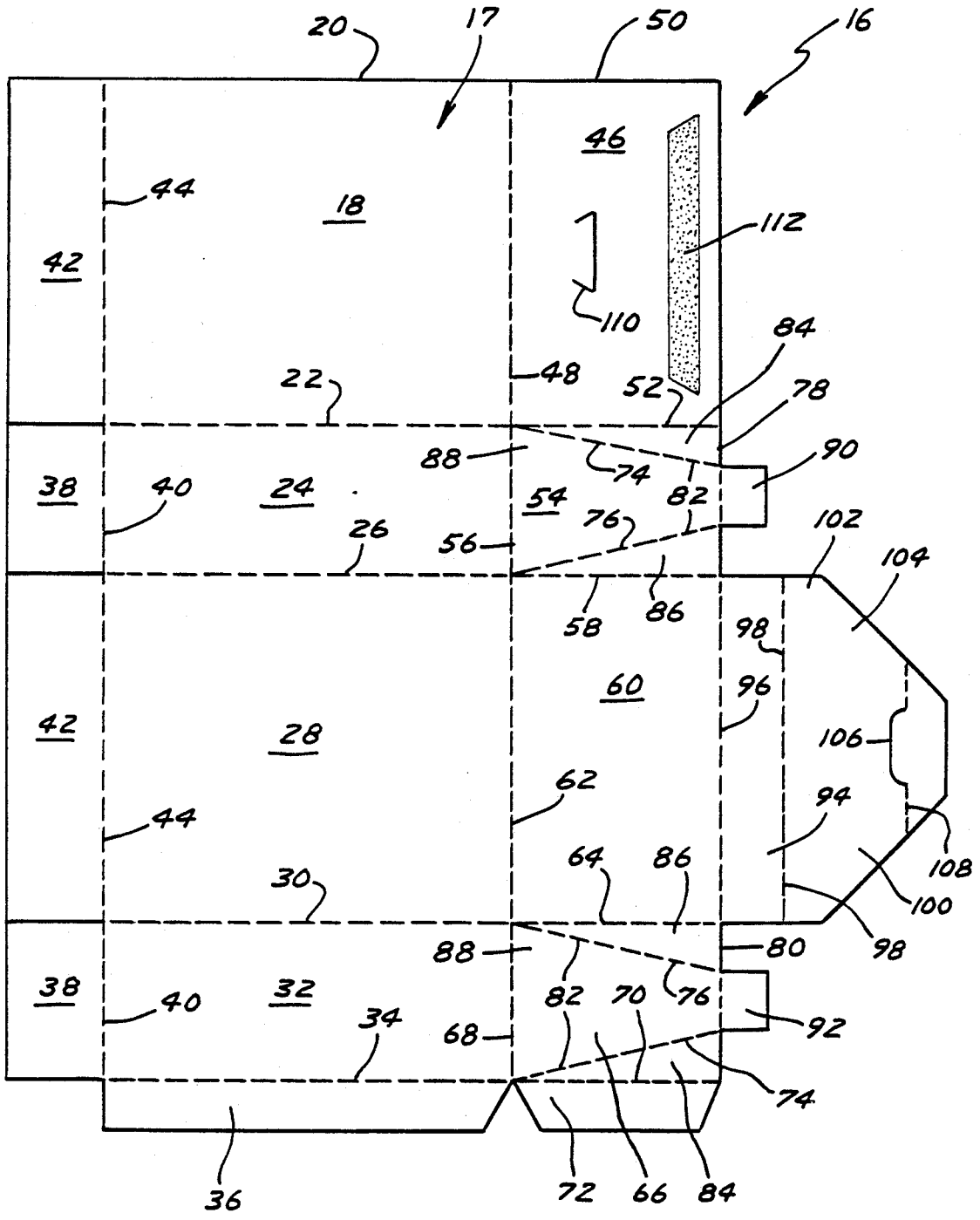
FIG. 2 shows a top plan view of a blank that may be folded into the carton of the package of FIG. 1.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "first", "second", "inside", "outside", "edge", "side", "front", "back", "length", "width", "inner", "outer", and similar terms are used herein, it should be understood that these terms have reference only to the structure shown in the drawings as it would appear to a person viewing the drawings and are utilized only to facilitate describing the invention.

DESCRIPTION

A package according to the preferred teachings of the present invention is shown in the drawings and generally designated 10. Generally, package 10 includes an outer carton 12 and an inner liner 14. Liner 14 can be formed of any suitable material, such as glassine, wax paper, or plastic, and can be formed in any suitable manner as is well known in the art.

Carton 12 according to the teachings of the present invention is formed from a blank 16 of a single layer of generally stiff material such as paperboard. Blank 16 includes an outer surface 17 which has printed material and an inner surface 19 which is plain and does not include printed material. Blank 16 generally includes a front panel 18 having a free side edge 20 and a second side edge 22 which is integrally connected to the side edge 22 of a first side panel 24 about a fold line. The opposite side edge 26 of side panel 24 is integrally connected to the side edge 26 of a back panel 28 about a fold line. The opposite side edge 30 of back panel 28 is integrally connected to the side edge 30 of a second side panel 32 about a fold line. The opposite side edge 34 of side panel 32 is integrally connected to the side edge 34 of a glue flap 36 about a fold line. Glue flap 36 in the most preferred form has the shape of an isosceles trapezoid with the major base extending along edge 34. Outer surface 17 of flap 36 can be secured to inner surface 19 of front panel 18 by any suitable means such as glue with edges 20 and 34 being coextensive. With the glue flap 36 secured, edge 20 of panel 18 is connected to edge 34 of panel 32 about the fold line between panel 32 and glue flap 36. In the preferred form, side panels 24 and 32 extend generally perpendicularly between panels 18 and 28 in the most preferred form to form a hollow rectangular parallelepiped.

The bottom of carton 12 can be formed by any suitable manner. In the preferred form, side panels 24 and 32 include dust flaps 38 integrally extending from their bottom edges 40 about fold lines and having widths which are identical to side panels 24 and 32. Front and back panels 18 and 28 each include closure flaps 42 integrally extending from their bottom edges 44 about fold lines and having widths which are identical to panels 18 and 28. The lengths of flaps 38 and 42 from bottom edges 40 and 44 to their respective free edges are equal and at least equal to one-half of the widths of side panels 24 and 32 and of flaps 38 but less than the widths of panels 18, 24, 28, and 32. The side edges of flaps 38 and 42 are separated from each other. The bottom of carton 12 can then be formed by folding dust flaps 38 inwardly and generally perpendicular to side panels 24 and 32. Then one of the closure flaps 42 can be folded such that inner surface 19 thereof overlies at least portions of outer surfaces 17 of flaps 38. Thereafter, the other closure flap 42 can be folded such that inner surface 19 thereof overlies outer surfaces 17 of flaps 38 and possibly of portions of the first closure flap 42. The outer surfaces 17 of the inner flaps 38 and/or 42 can be secured to the inner surfaces 19 of the outer flaps 42 by any suitable means such as glue.

The top of carton 12 according to the teachings of the present invention is peak- or gable-shaped. In the most preferred form, blank 16 generally includes a front top panel 46 having a free top edge and a bottom edge 48 integrally connected to the top edge 48 of front panel 18 about a fold line. Panel 46 includes a first, free side edge 50 and an opposite side edge 52 integrally connected to the side edge 52 of a first side top panel 54 about a fold line. Panel 54 includes a bottom edge 56 integrally connected to the top edge 56 of side panel 24 about a fold line. The opposite side edge 58 of panel 54 is integrally connected to the side edge 58 of a back top panel 60 about a fold line. Panel 60 includes a bottom edge 62 integrally connected to the top edge 62 of back panel 28 about a fold line. The opposite side edge 64 of panel 60 is integrally connected to the side edge 64 of a second side top panel 66 about a fold line. Panel 66 includes a bottom edge 68 integrally connected to the top edge 68 of side panel 32 about a fold line. The opposite side edge 70 of panel 66 is integrally connected to the side edge 70 of a glue flap 72 about a fold line. In the most preferred form, glue flap 72 has the shape of an isosceles trapezoid with the major base extending along edge 70. Outer surface 17 of flap 72 can be secured to inner face 19 of panel 46 by any suitable means such as glue with edges 50 and 70 being coextensive. With glue flap 72 secured, edge 50 of panel 46 is connected to edge 70 of panel 66 about the fold line between panel 66 and glue flap 72.

To form the peak- or gable-shape of the top of carton 12, side top panels 54 and 66 each include first and second fold lines 74 and 76 extending in a nonintersecting manner from the intersections of their respective bottom edges and side edges to spaced locations along their top edges 78 and 80, respectively. Specifically, fold line 74 of panel 54 extends from the intersection of edges 52 and 56, fold line 74 of panel 66 extends from the intersection of edges 68 and 70, fold line 76 of panel 54 extends from the intersection of edges 56 and 58, and fold line 76 of panel 66 extends from the intersection of edges 64 and 68. In the most preferred form, fold lines 74 and 76 include spaced perforations 82 extending coextensive therewith. It should be noted that each of panels 54 and 66 is then divided into first and second right triangles 84 and 86 of identical size and an isosceles trapezoid 88. Particularly, triangles 84 and 86 have first legs of equal length extending along edges 78 and 80, second legs of equal length extending along edges 52, 58, 64, and 70, and hypotenuses extending along fold lines 74 and 76. The major bases of trapezoids 88 extend along edges 56 and 68. The minor bases of trapezoids 88 extend along edges 78 and 80 intermediate the first legs of triangles 84 and 86.

According to the teachings of the present invention, blank 16 further includes top end flaps 90 and 92 integrally extending from top edges 78 and 80 of panels 54 and 66, respectively, about fold lines. Flaps 90 and 92 are rectangular shaped having a width between their side edges equal to the spacing between fold lines 74 and 76 along edges 78 and 80 (i.e. the width of the minor bases of trapezoids 88) and a length between their free, top edges and bottom edges 78 and 80 (i.e. the length of the side edges) which is generally equal to the spacing along edges 78 and 80 between the ends of fold lines 74 and 76 and edges 52 and 70 and edges 58 and 64, respectively (i.e. the lengths of the first legs of triangles 84 and 86).

According to the teachings of the present invention, blank 16 further includes a top panel 94 integrally connected to panel 60 by their respective bottom and top edges 96 defining a fold line. Top panel 94 has a width generally equal to panels 42, 28, and 60 and a length generally equal to the width of flaps 90 and 92 and the spacing between fold lines 74 and 76 along edges 78 and 80 (i.e. the minor bases of the trapezoids 88).

The opposite edge 98 of panel 94 is integrally connected to the bottom edge 98 of a closure panel 100 about a fold line. Closure panel 100 generally includes a rectangular portion 102 integrally extending from and having a width generally equal to panel 94 and a length less than the length of panel 94. Closure panel 100 further includes an isosceles trapezoid portion 104 integrally and contiguously extending from portion 102, with the major base of portion 104 extending along portion 102. Portion 104 includes a generally U-shaped die cut 106 having a central portion extending generally parallel to and spaced from the major and minor bases of portion 104 and first and second legs extending outwardly from the opposite ends of the central portion towards the minor base of portion 104. Portion 104 further includes first and second fold lines 108 extending parallel to edge 98 from the sides of portion 104 to the free ends of the first and second legs of die cut 106.

In the most preferred form, panel 46 of blank 16 further includes a generally U-shaped die cut 110 having a central portion extending generally parallel to and spaced from edge 48 and the free top edge of panel 46 and first and second legs extending inwardly from the opposite ends of the central portion towards edge 48. The length of central portion of die cut 110 is generally equal to but slightly longer than the distance between the free ends of the legs of die cut 106. The distance of the central portion of die cut 110 from the free top edge of panel 46 is generally equal to the distance of the free ends of the legs of die cut 106 and fold lines 108 from edge 98. Additionally, die cuts 106 and 110 are located at generally equal longitudinal locations in panels 100 and 46, respectively.

To close carton 12, trapezoids 88 of panels 54 and 66 can be pushed inwardly adjacent edges 78 and 80 such that triangles 84 and 86 are pivoted about fold lines 74 and 76 until inner surface 19 of triangle 84 of panel 54 abuts with inner surface 19 of panel 46, until inner surface 19 of triangle 84 of panel 66 abuts with inner surface 19 of glue flap 72 and possibly of panel 46 and until inner surfaces 19 of triangles 86 of panels 54 and 66 abut with surface 19 of panel 60. It should be noted that with blank 16 formed from a cylinder grade board, the top ply thereof is of a smoother layer for providing a readily printable surface. Also, triangles 84 and 86 tend to resist pivoting inwardly relative to trapezoids 88 with outer surfaces 17 thereof extending at an angle less than 180° and especially extending at a perpendicular angle. Perforations 82 weaken side panels 54 and 66 to encourage side panels 54 and 66 to fold inwardly to overcome the resistance towards the inward pivoting of triangles 84 and 86. Further, placement of glue flap 72 on side panel 66 for attachment to front panel 46, which is opposite to the industry standard, eliminates triangle 84 of side panel 66 being of a double thickness which would also have a tendency to resist triangle 84 from bending inwardly relative to trapezoid 88. Further, the separate formation of glue flaps 36 and 72 and their trapezoid configuration also provides ease of bending between glue flaps 36 and 72 and associated panels as compared to if the glue flaps were formed as a single continuous strip along edges 34 and 70. In this position, trapezoids 88 are generally perpendicular to triangles 84 and 86 and to panels 46 and 60. Also in this position, flaps 90 and 92 can be pivoted outwardly about edges 78 and 80, respectively, to extend generally perpendicularly between triangles 84 and 86. It should then be noted that trapezoids 88 of panels 54 and 66 extend from panels 24 and 32 at an obtuse angle and extend from flaps 90 and 92 at an acute angle. In this position, panel 94 can be pivoted about edge 96 so that inner surface 19 of panel 94 engages inner surfaces 19 of flaps 90 and 92 and edges 78 and 80 of panels 54 and 66 and the free upper edge of panel 46. In the preferred form, panels 46, 54, 60, 66, and 94 can be held in by pivoting panel 100 about edge 98 so that inner surface 19 of panel 100 abuts with outer surface 17 of panel 46. Panel 100 can then be suitably secured to panel 46.

For example, during manufacture, outer surface 17 of panel 46 can be suitably secured to inner surface 19 of panel 100 such as by glue or adhesive, with such securement being releasable by lifting the free edge of trapezoid portion 104. In the most preferred form, the glue or adhesive is applied to secure panel 100 to panel 46 in a tear away release area 112 formed in panel 46 in the form of a circuitous die cut extending from outer surface 17 towards but spaced from inner surface 19, which in its preferred form is in the shape of an isosceles triangle. Release area 112 provides a control tearing to prevent delaminating or bearding of panel 46 outside of area 112.

After carton 12 has been opened by the consumer, panel 100 can be removably secured to panel 46 by pivoting the tab defined by die cut 106 in panel 100 about fold lines 108 for slideable receipt in die cut 110 formed in panel 46 forming a reverse entry lock. Specifically, it should be realized that the tab defined by die cut 106 extends toward edge 98 and forms a hook which engages die cut 110 and generally will not disengage with upward movement of panel 100 in the direction tab defined by die cut 106 extends from fold lines 108 which would occur, for example, if carton 12 were carried by abutting outer surface 17 of end flaps 90 and 92. It should also be realized that the tab formed by die cut 106 is often pivoted by abutting the thumb with outer surface 17 and the side of the fore finger with inner surface 19 of portion 104 beyond fold lines 108. The decreasing width of panel 100 reduces the length of fold lines 108 and the possibility of panel 100 creasing outside of fold lines 108 as could occur with a centrally placed force and longer fold lines 108 such as if panel 100 had a constant width generally equal to portion 102 and panel 94. In the preferred form, the width of each of fold lines 108 is less than the width of the tab formed by die cut 106 in panel 100.

It should then be appreciated that carton 12 according to the teachings of the present invention has a totally "finished" appearance while only requiring blank 16 to be printed only on outer surface 17. Specifically, with carton 12 constructed according to the teachings of the present invention in its closed position, inner surface 19 of blank 16 is not visible to the consumer as it is either located inside carton 12, is covered by triangles 84 and 86 or by end flaps 90 and 92. Particularly, since the length of the side edges of end flaps 90 and 92 is equal to the lengths of the first legs of triangles 84 and 86 extending along edges 78 and 80 and the width of end flaps 90 and 92 is equal to the lengths of the minor bases of trapezoids 88 along edges 78 and 80 and the width of top panel 94, end flaps 90 and 92 completely cover inside surface 19 of top panel 94 which is not inside carton 12. It can then be appreciated that outer surface 17 of end flaps 90 and 92 can include suitable printing for enhancing the appearance of carton 12 in its closed position.

It should further be appreciated that package 10 according to the teachings of the present invention can be made on a double package maker, on a bag in box system, or like process.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A package comprising, in combination: a carton, with the carton including a gable-shaped top comprising, in combination: a front panel having inside and outside surfaces, a free top edge, and first and second side edges; first and second side panels, with each of the side panels including inside and outside surfaces, a top edge, and first and second side edges; a back panel including inside and outside surfaces, a top edge, and first and second side edges, with the first edges of the front and first side panels being connected about a fold line, with the second edges of the front and second side panels being connected about a fold line, with the second edges of the back and first side panels being connected about a fold line, with the first edges of the back and second side panels being connected about a fold line, with each of the side panels being divided into first and second right triangles and a generally isosceles trapezoid by first and second fold lines, with the right triangles having first legs of equal length extending along the top edges of the side panels and second legs extending along the side edges of the side panels, with the generally isosceles trapezoid having a minor base extending along the top edges of the side panels intermediate the first legs of the right triangles; first and second rectangular shaped end flaps having a top edge, a bottom edge, and first and second side edges, with the bottom edges of the end flaps being connected to and having an equal width to the minor bases of the generally isosceles trapezoids of the side panels, with the lengths of the first legs of the first and second right triangles being equal to the length of the side edges of the end flaps; a top panel having a top edge, a bottom edge, and first and second side edges, with the bottom edge of the top panel being connected to the top edge of the back panel about a fold line, with the length of the side edges of the top panel being equal to the lengths of the minor bases of the generally isoscele trapezoids of the side panels; and means for holding the top panel with the inside surfaces of the first and second right triangles of the first and second side panels abutting with the inside surfaces of the front and back panels, with the end flaps extending perpendicularly between the second legs of the first and second right triangles of the first and second side panes, and with the inside surface of the top panel abutting with the inside surfaces of the end flaps, the first legs of the first and second right triangles, and the top edge of the front panel.

2. The package of claim 1 wherein the holding means comprises, in combination: a closure panel having inside and outside surfaces, a top edge, and a bottom edge, with the bottom edge of the closure panel being connected to the top edge of the top panel about a fold line; and means for securing the closure panel to the front panel with the inside surface of the closure panel abutting with the outside surface of the front panel.

3. The package of claim 2 wherein the securing means comprises means for removably securing the closure panel to the front panel.

4. The package of claim 3 wherein the securing means comprises, in combination: a tab die cut intermediate the top and bottom edges of the closure panel and extending towards the bottom edge of the closure panel; and a slot die cut in the front panel for removable slideable receipt of the tab of the closure panel.

5. The package of claim 4 wherein the closure panel includes first and second side edges, and wherein the securing means further comprises, in combination: first and second fold lines extending from the tab to the respective side edges of the closure panel, with the first and second fold lines of the closure panel being parallel to the fold line between the closure and top panels.

6. The package of claim 5 wherein the spacing between the first and second side edges of the closure panel decreases from the bottom edge to the top edge, with the width of each of the first and second fold lines being less than the width of the tab of the closure panel.

7. The package of claim 6 wherein the fold lines dividing the side panels into the first and second right triangles and the generally isosceles trapezoid include perforations

8. The package of claim 7 further comprising, in combination: a liner located inside of the carton.

9. The package of claim 8 wherein the package is formed from a blank of a single layer of material, with one of the first and second side panels including a glue flap for securement to the inner face of the adjacent panel.

10. The package of claim 9 wherein the glue flap has the shape of an isosceles trapezoid with the major base extending along the side edge of the side panel and the minor base being shorter than, spaced from, and parallel to the side of the side panel.

11. The package of claim 1 wherein the fold lines dividing the side panels into the first and second right triangles and the generally isosceles trapezoid include perforations.

12. The package of claim 1 further comprising, in combination: a liner located inside of the carton.

13. The package of claim 1 wherein the package is formed from a blank of a single layer of material, with one of the first and second side panels including a glue flap for securement to the inner face of the adjacent panel.

14. The package of claim 13 wherein the glue flap has the shape of an isosceles trapezoid with the major base extending along the side edge of the side panel and the minor base shorter than, spaced from, and parallel to the side edge of the side panel.

* * * * *